US008128759B2

(12) United States Patent
Nagata et al.

(10) Patent No.: US 8,128,759 B2
(45) Date of Patent: Mar. 6, 2012

(54) PERMANENT MAGNET AND METHOD OF MANUFACTURING SAME

(75) Inventors: Hiroshi Nagata, Ibaraki (JP); Kyuzo Nakamura, Kanagawa (JP); Takeo Katou, Kanagawa (JP); Atsushi Nakatsuka, Kanagawa (JP); Ichirou Mukae, Kanagawa (JP); Masami Itou, Kanagawa (JP); Ryou Yoshiizumi, Kanagawa (JP); Yoshinori Shingaki, Ibaraki (JP)

(73) Assignee: Ulvac, Inc., Kanagawa (JP)

( * ) Notice: Subject to any disclaimer, the term of this patent is extended or adjusted under 35 U.S.C. 154(b) by 320 days.

(21) Appl. No.: 12/519,871

(22) PCT Filed: Dec. 19, 2007

(86) PCT No.: PCT/JP2007/074404

§ 371 (c)(1),
(2), (4) Date: Jul. 30, 2009

(87) PCT Pub. No.: WO2008/075709

PCT Pub. Date: Jun. 26, 2008

(65) Prior Publication Data

US 2010/0051140 A1 Mar. 4, 2010

(30) Foreign Application Priority Data

Dec. 21, 2006 (JP) ..... 2006-344779

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS

| | | | |
|---|---|---|---|
| 7,488,393 | B2 | 2/2009 | Nakamura et al. |
| 2006/0213583 | A1 | 9/2006 | Nakamura et al. |
| 2007/0034299 | A1 | 2/2007 | Machida et al. |

(Continued)

FOREIGN PATENT DOCUMENTS

| | | | |
|---|---|---|---|
| CN | 1838342 | A | 9/2006 |

(Continued)

OTHER PUBLICATIONS

Office Action for Chinese Patent App. No. 200780047143.6 (May 6, 2011).

(Continued)

*Primary Examiner* — John Sheehan
(74) *Attorney, Agent, or Firm* — Cermak Nakajima LLP; Tomoko Nakajima

(57) ABSTRACT

By causing at least one of Dy and Tb to be adhered to the surface of an iron-boron-rare earth based sintered magnet of a predetermined shape, and is then to be diffused into grain boundary phase, a permanent magnet can be manufactured at high workability and low cost. An iron-boron-rare earth based sintered magnet is disposed in a processing chamber and is heated to a predetermined temperature. Also, an evaporating material made up of a fluoride containing at least one of Dy and Tb disposed in the same or another processing chamber is evaporated, and the evaporated evaporating material is caused to be adhered to the surface of the sintered magnet. The Dy and/or Tb metal atoms of the adhered evaporating material are diffused into the grain particle phase of the sintered magnet before a thin film made of the evaporated material is formed on the surface of the sintered magnet.

16 Claims, 8 Drawing Sheets

| | Evaporating source | Vapor Processing Time(h) | Br(kG) | iHc(kOe) | (BH)max(MGOe) | (BH)max+iHc |
|---|---|---|---|---|---|---|
| Compar-ative Example 1a | No | 0 | 13.6 | 15.8 | 44.7 | 60.5 |
| | Dy | 1 | 13.6 | 18.9 | 45.1 | 64.0 |
| | Dy | 10 | 13.6 | 21.5 | 45.0 | 66.5 |
| | Dy | 18 | 13.6 | 24.3 | 44.7 | 69.0 |
| Example 1a | $DyF_3$ | 1 | 13.6 | 20.9 | 45.0 | 65.9 |
| | $DyF_3$ | 10 | 13.6 | 24.2 | 45.1 | 69.3 |
| | $DyF_3$ | 18 | 13.6 | 24.1 | 45.0 | 69.1 |

U.S. PATENT DOCUMENTS

| | | | | |
|---|---|---|---|---|
| 2009/0322459 | A1 * | 12/2009 | Nagata et al. | 335/302 |
| 2010/0164663 | A1 * | 7/2010 | Nagata et al. | 335/302 |

FOREIGN PATENT DOCUMENTS

| | | | |
|---|---|---|---|
| EP | 1 643 513 | A1 * | 4/2006 |
| JP | 2005-175138 | | 6/2005 |
| JP | 2006-303433 | | 11/2006 |
| WO | WO2004/114333 | A1 | 12/2004 |
| WO | WO2006-100968 | | 9/2006 |

OTHER PUBLICATIONS

Kite, P., "Improvement of coercivity on thin Nd2Fe14B sintered permanent magnets," Mar. 23, 2000, Tohoku University, Doctor Thesis.

International Search Report for PCT Patent App. No. PCT/JP2007/074404 (Mar. 18, 2008).

* cited by examiner

FIG.5

| | Evaporating source | Vapor Processing Time(h) | Br(kG) | iHc(k0e) | (BH)max(MG0e) | (BH)max+iHc |
|---|---|---|---|---|---|---|
| Compar-ative Example 1a | No | 0 | 13.6 | 15.8 | 44.7 | 60.5 |
| | Dy | 1 | 13.6 | 18.9 | 45.1 | 64.0 |
| | Dy | 10 | 13.6 | 21.5 | 45.0 | 66.5 |
| | Dy | 18 | 13.6 | 24.3 | 44.7 | 69.0 |
| Example 1a | $DyF_3$ | 1 | 13.6 | 20.9 | 45.0 | 65.9 |
| | $DyF_3$ | 10 | 13.6 | 24.2 | 45.1 | 69.3 |
| | $DyF_3$ | 18 | 13.6 | 24.1 | 45.0 | 69.1 |

FIG.6

| | Evaporating source | Vapor Processing Time(h) | Br(kG) | iHc(k0e) | (BH)max(MG0e) | (BH)max+iHc |
|---|---|---|---|---|---|---|
| Compar-ative Example 1b | No | 0 | 13.6 | 15.8 | 44.7 | 60.5 |
| | Tb | 1 | 13.6 | 20.9 | 45.2 | 66.1 |
| | Tb | 10 | 13.7 | 25.1 | 45.0 | 70.1 |
| | Tb | 18 | 13.7 | 28.3 | 45.1 | 73.4 |
| Example 1b | TbF3 | 1 | 13.6 | 25.3 | 45.1 | 70.4 |
| | TbF3 | 10 | 13.6 | 28.2 | 45.0 | 73.2 |
| | TbF3 | 18 | 13.7 | 28.3 | 45.1 | 73.4 |

FIG.7

| | Evaporating source | | Br(kG) | iHc(k0e) | (BH)max (MG0e) | (BH)max+iHc |
|---|---|---|---|---|---|---|
| Comparative Example 2b | $DyF_3$ | | 13.6 | 24.2 | 45.1 | 69.3 |
| Comparative Example 2a | $DyF_3$ | | 13.6 | 21.6 | 45.1 | 66.7 |
| Example 2a | 90 $DyF_3$ | 10 $NdF_3$ | 13.6 | 26.1 | 45.2 | 71.3 |
| | 80 $DyF_3$ | 20 $NdF_3$ | 13.7 | 26.5 | 45.2 | 71.7 |
| | 70 $DyF_3$ | 30 $NdF_3$ | 13.7 | 26.7 | 45.3 | 72.0 |
| | 60 $DyF_3$ | 40 $NdF_3$ | 13.8 | 26.8 | 46.0 | 72.8 |
| | 50 $DyF_3$ | 50 $NdF_3$ | 13.8 | 26.8 | 46.2 | 73.0 |
| | 40 $DyF_3$ | 60 $NdF_3$ | 13.8 | 26.9 | 46.3 | 73.2 |
| | 30 $DyF_3$ | 70 $NdF_3$ | 13.8 | 26.9 | 46.3 | 73.2 |
| | 20 $DyF_3$ | 80 $NdF_3$ | 13.9 | 27.2 | 46.5 | 73.7 |
| | 10 $DyF_3$ | 90 $NdF_3$ | 14.0 | 27.8 | 47.3 | 75.1 |
| | 1 $DyF_3$ | 99 $NdF_3$ | 13.9 | 26.8 | 46.7 | 73.5 |
| | 50 $DyF_3$ | 50 $PrF_3$ | 13.8 | 27.5 | 46.7 | 74.2 |

FIG.8

| | Evaporating source | | Br(kG) | iHc(k0e) | (BH)max (MG0e) | (BH)max+iHc |
|---|---|---|---|---|---|---|
| Comparative Example 2d | $TbF_3$ | | 13.6 | 28.2 | 45.0 | 73.2 |
| Comparative Example 2c | $TbF_3$ | | 13.6 | 28.2 | 45.0 | 73.2 |
| Example 2b | 90 $TbF_3$ | 10 $NdF_3$ | 13.6 | 32.1 | 45.1 | 77.2 |
| | 80 $TbF_3$ | 20 $NdF_3$ | 13.7 | 32.5 | 45.1 | 77.6 |
| | 70 $TbF_3$ | 30 $NdF_3$ | 13.7 | 32.6 | 45.2 | 77.8 |
| | 60 $TbF_3$ | 40 $NdF_3$ | 13.7 | 32.8 | 45.9 | 78.7 |
| | 50 $TbF_3$ | 50 $NdF_3$ | 13.8 | 33.9 | 46.1 | 80.0 |
| | 40 $TbF_3$ | 60 $NdF_3$ | 13.8 | 34.2 | 46.2 | 80.4 |
| | 30 $TbF_3$ | 70 $NdF_3$ | 13.9 | 34.7 | 46.2 | 80.9 |
| | 20 $TbF_3$ | 80 $NdF_3$ | 13.9 | 35.6 | 46.4 | 82.0 |
| | 10 $TbF_3$ | 90 $NdF_3$ | 14.0 | 36.3 | 47.2 | 83.5 |
| | 1 $TbF_3$ | 99 $NdF_3$ | 13.9 | 34.3 | 46.6 | 80.9 |
| | 50 $TbF_3$ | 50 $PrF_3$ | 13.8 | 35.7 | 46.6 | 82.3 |

FIG.9

Evaporating source 90DyF310A

| | Element A | Mixing Ratio(wt%) | Br(kG) | iHc(kOe) | (BH)max(MGOe) | (BH)max+iHc |
|---|---|---|---|---|---|---|
| Comparative Example 2d | No | No | 13.6 | 24.2 | 45.1 | 69.3 |
| Example 3a | Al | 50 | 13.7 | 29.2 | 45.7 | 74.9 |
| | Ag | 50 | 13.7 | 27.3 | 45.3 | 72.6 |
| | B | 50 | 13.8 | 26.8 | 45.1 | 71.9 |
| | Ba | 50 | 13.8 | 26.7 | 45.5 | 72.2 |
| | Be | 50 | 13.7 | 27.2 | 45.1 | 72.3 |
| | C | 50 | 13.8 | 26.8 | 46.0 | 72.8 |
| | Cu | 50 | 13.7 | 29.3 | 45.6 | 74.9 |
| | Ca | 50 | 13.7 | 26.9 | 45.1 | 71.9 |
| | Ce | 50 | 13.7 | 27.3 | 45.1 | 72.4 |
| | Co | 50 | 13.7 | 26.9 | 45.2 | 72.1 |
| | Cr | 50 | 13.8 | 26.6 | 45.7 | 72.2 |
| | Cs | 50 | 13.8 | 26.8 | 45.8 | 72.5 |
| | Dy | 50 | 13.8 | 26.5 | 46.0 | 72.4 |
| | Er | 50 | 13.8 | 26.4 | 45.4 | 71.8 |
| | Eu | 50 | 13.8 | 26.7 | 45.6 | 72.3 |
| | Fe | 50 | 13.7 | 26.8 | 45.4 | 72.3 |
| | Ga | 1 | 13.7 | 29.0 | 45.5 | 74.5 |
| | Gd | 50 | 13.8 | 26.8 | 45.1 | 71.9 |
| | Ge | 50 | 13.8 | 26.6 | 45.7 | 72.3 |
| | Hf | 50 | 13.8 | 26.8 | 45.6 | 72.4 |
| | Ho | 50 | 13.8 | 26.7 | 45.9 | 72.6 |
| | In | 50 | 13.8 | 26.5 | 45.5 | 71.9 |
| | K | 50 | 13.7 | 27.3 | 45.9 | 73.2 |
| | La | 50 | 13.7 | 27.1 | 45.2 | 72.4 |
| | Li | 50 | 13.8 | 26.7 | 45.7 | 72.5 |
| | Lu | 50 | 13.7 | 26.9 | 45.1 | 72.0 |
| | Mg | 50 | 13.7 | 26.9 | 45.6 | 72.5 |
| | Mn | 50 | 13.7 | 27.1 | 45.5 | 72.6 |
| | Mo | 50 | 13.7 | 26.8 | 45.4 | 72.2 |
| | Na | 50 | 13.7 | 26.9 | 45.2 | 72.2 |
| | Nb | 50 | 13.7 | 27.1 | 45.3 | 72.4 |
| | Nd | 50 | 13.8 | 28.1 | 46.0 | 74.1 |
| | Ni | 50 | 13.7 | 26.9 | 45.2 | 72.0 |
| | P | 50 | 13.8 | 26.7 | 45.5 | 72.2 |
| | Pd | 50 | 13.7 | 26.8 | 45.2 | 72.0 |
| | Pr | 50 | 13.7 | 28.9 | 45.4 | 74.3 |
| | Ru | 50 | 13.7 | 27.3 | 45.2 | 72.4 |
| | S | 50 | 13.8 | 26.4 | 45.7 | 72.0 |
| | Sb | 50 | 13.7 | 27.0 | 45.0 | 72.1 |
| | Si | 50 | 13.7 | 26.9 | 45.3 | 72.2 |
| | Sm | 50 | 13.8 | 26.4 | 45.5 | 72.0 |
| | Sn | 50 | 13.7 | 26.8 | 46.0 | 72.8 |
| | Sr | 50 | 13.8 | 26.4 | 45.4 | 71.8 |
| | Ta | 50 | 13.8 | 26.4 | 45.2 | 71.6 |
| | Tb | 50 | 13.8 | 28.6 | 45.7 | 74.4 |
| | Ti | 50 | 13.7 | 26.8 | 45.7 | 72.5 |
| | Tm | 50 | 13.7 | 26.5 | 45.1 | 71.6 |
| | V | 50 | 13.7 | 26.9 | 45.1 | 72.0 |
| | W | 50 | 13.8 | 26.6 | 45.4 | 72.0 |
| | Y | 50 | 13.7 | 27.2 | 45.6 | 72.8 |
| | Yb | 50 | 13.8 | 26.5 | 45.6 | 72.1 |
| | Zn | 50 | 13.7 | 27.2 | 45.7 | 72.9 |
| | Zr | 50 | 13.7 | 27.1 | 45.1 | 72.2 |

FIG.10

Evaporating source90TbF310A

| | Element A | Mixing Ratio(wt%) | Br(kG) | iHc(k0e) | (BH)max(MG0e) | (BH)max+iHc |
|---|---|---|---|---|---|---|
| Comparative Example 2d | No | No | 13.6 | 28.2 | 45.0 | 73.2 |
| Example 3a | Al | 50 | 13.8 | 31.4 | 45.0 | 76.5 |
| | Ag | 50 | 13.8 | 29.8 | 45.5 | 75.3 |
| | B | 50 | 13.7 | 30.0 | 46.0 | 76.0 |
| | Ba | 50 | 13.8 | 29.6 | 45.3 | 74.9 |
| | Be | 50 | 13.8 | 29.4 | 45.5 | 74.9 |
| | C | 50 | 13.8 | 29.6 | 45.3 | 74.9 |
| | Cu | 50 | 13.7 | 31.6 | 45.4 | 77.0 |
| | Ca | 50 | 13.7 | 30.3 | 45.2 | 75.4 |
| | Ce | 50 | 13.8 | 29.5 | 45.6 | 75.1 |
| | Co | 50 | 13.7 | 30.0 | 45.4 | 75.4 |
| | Cr | 50 | 13.7 | 30.3 | 45.2 | 75.5 |
| | Cs | 50 | 13.7 | 30.1 | 46.0 | 76.0 |
| | Dy | 50 | 13.7 | 32.0 | 45.8 | 77.8 |
| | Er | 50 | 13.7 | 30.3 | 45.2 | 75.6 |
| | Eu | 50 | 13.7 | 30.3 | 45.5 | 75.8 |
| | Fe | 50 | 13.7 | 30.1 | 45.7 | 75.8 |
| | Ga | 1 | 13.8 | 31.2 | 45.5 | 76.8 |
| | Gd | 50 | 13.8 | 29.7 | 45.3 | 75.0 |
| | Ge | 50 | 13.7 | 30.0 | 45.0 | 75.0 |
| | Hf | 50 | 13.8 | 29.6 | 45.8 | 75.4 |
| | Ho | 50 | 13.8 | 29.6 | 45.8 | 75.4 |
| | In | 50 | 13.8 | 29.4 | 45.1 | 74.5 |
| | K | 50 | 13.8 | 29.7 | 46.0 | 75.7 |
| | La | 50 | 13.7 | 30.2 | 45.9 | 76.1 |
| | Li | 50 | 13.8 | 29.5 | 45.8 | 75.4 |
| | Lu | 50 | 13.7 | 30.1 | 45.2 | 75.3 |
| | Mg | 50 | 13.7 | 30.3 | 45.2 | 75.4 |
| | Mn | 50 | 13.7 | 30.1 | 45.6 | 75.7 |
| | Mo | 50 | 13.8 | 29.6 | 45.7 | 75.2 |
| | Na | 50 | 13.7 | 30.2 | 45.1 | 75.3 |
| | Nb | 50 | 13.8 | 29.6 | 45.8 | 75.4 |
| | Nd | 50 | 13.7 | 32.1 | 45.6 | 77.7 |
| | Ni | 50 | 13.7 | 30.1 | 45.3 | 75.3 |
| | P | 50 | 13.7 | 30.2 | 45.4 | 75.6 |
| | Pd | 50 | 13.8 | 29.9 | 46.0 | 75.9 |
| | Pr | 50 | 13.7 | 32.1 | 46.0 | 78.1 |
| | Ru | 50 | 13.7 | 30.1 | 45.6 | 75.7 |
| | S | 50 | 13.7 | 30.0 | 45.5 | 75.6 |
| | Sb | 50 | 13.8 | 29.7 | 45.9 | 75.7 |
| | Si | 50 | 13.8 | 29.6 | 45.1 | 74.7 |
| | Sm | 50 | 13.8 | 29.8 | 45.9 | 75.7 |
| | Sn | 50 | 13.8 | 29.7 | 45.6 | 75.2 |
| | Sr | 50 | 13.7 | 30.2 | 45.8 | 76.0 |
| | Ta | 50 | 13.7 | 30.4 | 45.1 | 75.5 |
| | Tb | 50 | 13.7 | 33.0 | 45.3 | 78.3 |
| | Ti | 50 | 13.7 | 29.9 | 45.4 | 75.3 |
| | Tm | 50 | 13.8 | 29.8 | 45.8 | 75.6 |
| | V | 50 | 13.7 | 30.2 | 45.8 | 76.0 |
| | W | 50 | 13.7 | 30.3 | 45.9 | 76.2 |
| | Y | 50 | 13.8 | 29.8 | 45.9 | 75.6 |
| | Yb | 50 | 13.8 | 29.7 | 45.9 | 75.6 |
| | Zn | 50 | 13.7 | 30.0 | 45.7 | 75.6 |
| | Zr | 50 | 13.8 | 29.8 | 45.4 | 75.2 |

FIG.11

| | Br(kG) | iHc(k0e) | (BH) max(MG0e) | (BH) max+iHc |
|---|---|---|---|---|
| Block | 14.4 | 10.5 | 51.4 | 61.9 |
| Cutting Without Vapor Processing | 14.4 | 9.3 | 43.3 | 52.6 |
| Block After Vapor Processing | 14.4 | 18.3 | 51.2 | 69.5 |
| Cutting After Vapor Processing | 14.4 | 18.2 | 48.8 | 67.0 |

PERMANENT MAGNET AND METHOD OF MANUFACTURING SAME

This application is a national phase entry under 35 U.S.C. §371 of PCT Patent Application No. PCT/JP2007/74404, filed on Dec. 19, 2007, which claims priority under 35 U.S.C. §119 to Japanese Patent Application No. 2006-344779, filed Dec. 21, 2006, both of which are incorporated by reference.

TECHNICAL FIELD

The present invention relates to a permanent magnet and a method of manufacturing the permanent magnet, and more particularly relates to a permanent magnet having high magnetic properties in which Dy and/or Tb is diffused into grain boundary phase of a Nd—Fe—B based sintered magnet, and to a method of manufacturing the permanent magnet.

BACKGROUND ART

A Nd—Fe—B based sintered magnet (so-called neodymium magnet) is made of a combination of iron and elements of Nd and B that are inexpensive, abundant, and stably obtainable natural resources and can thus be manufactured at a low cost and additionally has high magnetic properties (its maximum energy product is about 10 times that of ferritic magnet). Accordingly, the Nd—Fe—B sintered magnets have been used in various kinds of articles such as electronic devices and have recently come to be adopted in motors and electric generators for hybrid cars.

On the other hand, since the Curie temperature of the above-described sintered magnet is as low as about 300° C., there is a problem in that the Nd—Fe—B sintered magnet sometimes rises in temperature beyond a predetermined temperature depending on the circumstances of service of the product to be employed and therefore that it will be demagnetized by heat when heated beyond the predetermined temperature. In using the above-described sintered magnet in a desired product, there are cases where the sintered magnet must be fabricated into a predetermined shape. There is then another problem in that this fabrication gives rise to defects (cracks and the like) and strains to the grains of the sintered magnet, resulting in a remarkable deterioration in the magnetic properties.

Therefore, when the Nd—Fe—B sintered magnet is obtained, it is considered to add Dy and/or Tb which largely improve the grain magnetic anisotropy of principal phase because they have magnetic anisotropy of 4f-electron larger than that of Nd and because they have a negative Stevens factor similar to Nd. However, since Dy and/or Tb takes a ferrimagnetism structure having a spin orientation negative to that of Nd in the crystal lattice of the principal phase, the strength of magnetic field, accordingly the maximum energy product exhibiting the magnetic properties is extremely reduced.

In order to solve this kind of problem, it has been proposed: to form a film of Dy and/or Tb to a predetermined thickness (to be formed in a film thickness of above 3 μm depending on the volume of the magnet) over the entire surface of the Nd—Fe—B sintered magnet; then to execute heat treatment at a predetermined temperature; and to thereby homogeneously diffuse the Dy and/or Tb that has been deposited (formed into thin film) on the surface into the grain boundary phase of the magnet (see non-patent document 1).

The permanent magnet manufactured in the above-described method has an advantage in that: because Dy and/or Tb diffused into the grain boundary phase improves the grain magnetic anisotropy of each of the grain surfaces, the nucleation type of coercive force generation mechanism is strengthened; as a result, the coercive force is dramatically improved; and the maximum energy product will hardly be lost (it is reported in non-patent document 1 that a magnet can be obtained having a performance, e.g., of the remanent flux density: 14.5 kG (1.45 T), maximum energy product: 50 MGOe (400 kJ/m$^3$), and coercive force: 23 kOe (3 MA/m)).

[Non-patent document 1] Improvement of coercivity on thin $Nd_2Fe_{14}B$ sintered permanent magnets (by Pak Kite of Tohoku University, Doctor Thesis, Mar. 23, 2000)

DISCLOSURE OF THE INVENTION

[Problems to be Solved by the Invention]

Regarding Dy metal or Tb metal as the film forming material, it is required to be of high quality. It is therefore usual to first manufacture a fluoride of Dy, Tb in a known method such as a dry method or a wet method, and then manufacture them in a fluoride molten salt bath oxide charging electrolytic process in which metal can be obtained which contains little or no impurities of chlorides, oxygen, and the like and in which magnetic properties are expected to be improved. However, there was a problem in that the Dy metal or Tb metal obtained in the above-described processes are very expensive. In this case, since there is used Dy and/or Tb that is both expensive and poor as natural resources and stable supply of which cannot be expected, it is necessary to efficiently execute the film formation of Dy and/or Tb on the surface of the sintered magnet and the diffusion thereof into the grain boundary phase, thereby improving the productivity and reducing the cost. On the other hand, if the coercive force, for example, is further increased, there can be obtained a permanent magnet with a strong magnetic force even with a smaller thickness. Therefore, in order to attempt to reduce the size, weight and power consumption of the products in which this kind of permanent magnet is employed, it is desired to develop a permanent magnet that has a still higher coercive force and high magnetic properties than the one in the above-described conventional art.

Therefore, in view of the above-described points, it is a first object of the invention to provide a permanent magnet that has an extremely high coercive force and high magnetic properties. It is another object of the invention to provide a method of manufacturing a permanent magnet that has an extremely high coercive force and high magnetic properties, the method being capable of manufacturing the permanent magnet at a high productivity and low cost.

[Means for Solving the Problems]

In order to solve the above problems, the method of manufacturing a permanent magnet has steps of heating to a predetermined temperature an iron-boron-rare earth based sintered magnet disposed in a processing chamber; evaporating an evaporating material comprising a fluoride containing at least one of Dy and Tb, disposed in a same or another processing chamber; causing the evaporating material that has been evaporated to get adhered to a surface of the sintered magnet; and diffusing metal atoms of at least one of Dy and Tb of the adhered evaporating material into grain particle phase of the sintered magnet.

According to this invention, the fluoride (molecules) containing at least one of the evaporated Dy and Tb is supplied to, and adhered to, the surface of the sintered magnet that has been heated to a predetermined temperature (e.g., a temperature at which the optimum diffusion velocity can be obtained). The metal atoms of the adhered Dy and/or Tb are sequentially diffused into the grain boundary phase of the sintered magnet. In other words, the supply of the evaporated material to the surface of the sintered magnet and the diffusion of Dy and/or Tb into the grain boundary phase of the sintered magnet are executed in a single processing (vapor vacuum processing). In this case, since a fluoride of Dy and/or Tb was used as the evaporating material, the intermediate product (fluorides of Dy and/or Tb) produced in the course of manufacturing the Dy metal or Tb metal from ores can be used as the evaporating material. Since their prices are low, as compared with the case in which Dy metal and Tb metal are made the evaporating material, the manufacturing cost of the permanent magnet can be kept low. Further, because the melting point of the Nd-rich phase (the phase in which Dy and/or Tb is contained in the range of 5~80%) lowers due to the polytopic eutectic effect, the velocity of diffusion of metal atoms of Dy and/or Tb of the evaporating material further increases. In other words, at the time of diffusion into the grain boundary phase, a complicated eutectic will be formed such as Nd—F—O—Dy(Tb), and the like. In this case, since the eutectic point of the Nd-rich phase lying near the grain boundary phase is lower in the case of polytopic system as compared with the eutectic point of the binary system of Dy(Tb)—Fe, the velocity of diffusion of metal atoms of Dy and/or Tb becomes still higher, and the diffusion time is shortened, thereby attaining a high productivity.

If the evaporating material further comprises a fluoride containing at least one of Nd and Pr, the following can be attained: i.e., in addition to improvement in the magnetocrystalline anisotropy due to replacement of Dy and/or Tb with Nd, the strains and defects in the grain boundaries are repaired, whereby a higher coercive force can be obtained; further, unlike Dy and Tb, Nd and Pr take spin orientation which magnetizes in the same direction as Fe, therefore, the remanent flux density and the maximum energy product become higher; and, as a result, there can be obtained a permanent magnet having still higher magnetic properties as compared with the conventional ones. Still furthermore, since the melting point of the Nd-rich phase lowers due to polytopic eutectic effect, the velocity of diffusion of the metal atoms of Dy and/or Tb can be made still faster.

If the evaporating material further comprises at least one material of the group consisting of Al, Ag, B, Ba, Be, C, Ca, Ce, Co, Cr, Cs, Cu, Dy, Er, Eu, Fe, Ga, Gd, Ge, Hf, Ho, In, K, La, Li, Lu, Mg, Mn, Mo, Na, Nb, Nd, Ni, P, Pd, Pr, Ru, S, Sb, Si, Sm, Sn, Sr, Ta, Tb, Tm, Ti, V, W, Y, Yb, Zn, and Zr, there can be obtained an effect similar to that described hereinabove. In other words, at the time of diffusion, the elements of Al, Cu, Ga will be penetrated into the Nd-rich phase to thereby form a complicate eutectic such as Dy(Tb)—Nd (Pr)—Fe—Al(Cu,Ga), and the like. In this case, the eutectic point of the Nd-rich phase near the grain boundary is lower in the case of the polytopic system as compared with the eutectic point of the binary system of Dy—Fe(Tb—Fe). Therefore, the velocity of diffusion of metal atoms of Dy and/or Tb becomes still faster.

If the sintered magnet and the evaporating material are disposed at a distance from each other, when the evaporating material is evaporated, the molten material can advantageously be prevented from getting adhered directly to the sintered magnet.

Preferably, the method further comprises: executing increasing or decreasing an amount of evaporation at a constant temperature by varying a specific surface area of the evaporating material to be disposed in the processing chamber, thereby adjusting an amount of supply of the evaporated evaporating material to the surface of the sintered magnet. In this case, if an adjustment is made of the amount of supply of the evaporated material to the surface of the sintered magnet such that a thin film (layer) is not formed on the surface of the sintered magnet, the surface of the sintered magnet will remain substantially the same as the state before executing the above-described procedures. The surface conditions of the permanent magnet remains substantially the same as the one before executing the above-described procedures. In this manner, the permanent magnet can be prevented from deteriorating (surface roughness getting worse) in the surface thereof. Further, particularly, the Dy and/or Tb can be prevented from getting excessively diffused into the gain boundaries near the surface of the sintered magnet. As a result, post steps are not particularly required, thereby attaining a higher productivity. In addition, without the need of, e.g., changing the constitution of the apparatus by, e.g., providing inside the processing chamber with a separate part for increasing or decreasing the amount of supply of the evaporating material to the surface of the sintered magnet, the amount of supply to the surface of the sintered magnet can be easily adjusted.

In order to remove the stains, gases, and moisture adsorbed to the surface of the sintered magnet, prior to diffusing the metal atoms of Dy and/or Tb, and the like into the grain boundary phase, preferably the method further comprises reducing the pressure in the processing chamber to a predetermined pressure and keeping the pressure thereat prior to heating the processing chamber into which the sintered magnet has been disposed.

In this case, in order to accelerate the removal of the stains, gas, and moisture adsorbed to the surface, after having reduced the pressure in the processing chamber to the predetermined pressure, preferably the processing chamber shall be heated to a predetermined temperature and keeping the temperature thereat.

On the other hand, in order to remove an oxide film from the surface of the sintered magnet prior to diffusing the metal atoms of Dy and/or Tb and the like into the grain boundary phase, it is preferable to clean the surface of the sintered magnet by plasma prior to heating the processing chamber having housed therein the sintered magnet.

Preferably, the method further comprises, after having diffused the metal atoms into the grain boundary phase, heat-treating the permanent magnet at a predetermined temperature below the said temperature to remove strains of the permanent magnet. Then, there can be obtained a permanent magnet having high magnetic properties and in which the magnetization intensity and the coercive force are further improved.

Preferably, the method further comprises, after having diffused at least one of Dy and Tb into the grain boundary phase of the sintered magnet, cutting the permanent magnet into a predetermined thickness in a direction perpendicular to the magnetic alignment direction. According to this configuration, as compared with the case in which: a sintered magnet in block form having predetermined dimensions are cut into a plurality of thin pieces; the thin pieces are then orderly arrayed and are disposed into the processing chamber; and are then subjected to the above-described vacuum vapor processing, the work of, e.g., handling of the sintered magnet into, and out of, the processing chamber can be executed in a shorter time. The preparatory work of the above-described vacuum vapor processing became easier, resulting in an improvement in productivity.

In this case, if the sintered magnet is cut into the desired shape by means of a wire cutter, and the like, there are cases where the magnetic properties are remarkably deteriorated due to cracks generated in the crystal grains which are the principal phase on the surface of the sintered magnet. However, if the above-described vacuum vapor processing is executed, the grain particle phase has a Dy-rich phase and further Dy has been diffused only near the surface of the grains. Therefore, even if the sintered magnet is sliced into thin pieces to thereby obtain permanent magnets in a subsequent step, the magnetic properties are prevented from getting deteriorated. In combination with the fact that the finishing is not required, there can be obtained a permanent magnet which is superior in productivity.

Further, in order to solve the above problems, a permanent magnet has an iron-boron-rare earth based sintered magnet. The permanent magnet is characterized in: that the sintered magnet is disposed in a processing chamber and is heated to a predetermined temperature; that an evaporating material made of a fluoride containing at least one of Dy and Tb and disposed in a same or in another processing chamber is caused to be evaporated; that the evaporated material is caused to be adhered to a surface of the sintered magnet; and that metal atoms of at least one of Dy and Tb of the adhered evaporating material are caused to be diffused into grain boundary phase of the sintered magnet.

In this case, preferably, the evaporating material further comprises a fluoride containing at least one of Nd and Pr.

The evaporating material preferably comprises at least one material of the group consisting of Al, Ag, B, Ba, Be, C, Ca, Ce, Co, Cr, Cs, Cu, Dy, Er, Eu, Fe, Ga, Gd, Ge, Hf, Ho, In, K, La, Li, Lu, Mg, Mn, Mo, Na, Nb, Nd, Ni, P, Pd, Pr, Ru, S, Sb, Si, Sm, Sn, Sr, Ta, Tb, Tm, Ti, V, W, Y, Yb, Zn, and Zr.

The permanent magnet is preferably characterized in that, after having diffused at least one of Dy and Tb into the grain boundary phase of the sintered magnet, the sintered magnet is cut into a predetermined thickness in a direction perpendicular to the magnetic alignment direction.

EFFECTS OF THE INVENTION

As described hereinabove, the permanent magnet according to the invention has an effect in that, as compared with the conventional one, it has a still higher coercive force and high magnetic properties. According to the method of manufacturing the permanent magnet of this invention, there can be manufactured a permanent magnet that has a still higher coercive force and with high productivity at a lower cost.

BEST MODE FOR CARRYING OUT THE INVENTION

With reference to FIGS. 1 and 2, a permanent magnet M of the present invention is manufactured by simultaneously executing a series of processes (vacuum vapor processing) of: a first step in which an evaporating material v to be described hereinafter is caused to be evaporated and the evaporated material is caused to be adhered to a surface of a Nd—Fe—B based sintered magnet S that has been fabricated to a predetermined shape; and a second step in which, out of the evaporating material adhered to the surface of the sintered magnet S, the metal atoms of Dy and/or Tb are diffused into the grain boundary phase so as to be homogeneously spread (or penetrated).

The Nd—Fe—B sintered magnet S as the starting material is manufactured as follows by a known method. That is, Fe, B, Nd are formulated at a predetermined ratio of composition to first manufacture an alloy of 0.05 mm~0.5 mm by the known strip casting method. Alternatively, an alloy having a thickness of about 5 mm may be manufactured by the known centrifugal casting method. A small amount of Cu, Zr, Dy, Tb, Al or Ga may be added therein during the formulation. Then, the manufactured alloy is once ground by the known hydrogen grinding process and subsequently finely ground by the jet-mill fine grinding process, thereby obtaining alloy raw meal powder. Subsequently, by the known compression-molding machine, the alloy raw meal powder is oriented in the magnetic field (magnetically aligned) and is molded in a metallic mold into a predetermined shape such as a rectangular parallelepiped, column, and the like and, thereafter, is sintered under given conditions to manufacture the above-described sintered magnet.

In compression-molding the alloy raw meal powder, in case the known lubricant is added to the alloy raw meal powder, it is preferable to optimize the conditions in each of the steps of manufacturing the sintered magnet S so that the mean grain diameter of the sintered magnet S falls within the range of 4 μm~8 μm. According to this configuration, without being influenced by the residual carbon in the sintered magnet S, Dy and/or Tb adhered to the surface of the sintered magnet can be efficiently diffused into the grain boundary phase, thereby attaining high productivity.

In this case, if the mean grain diameter is smaller than 4 μm, a permanent magnet having a high coercive force can be obtained due to the diffusion of Dy and/or Tb into the grain boundary phase. However, this will diminish the advantage of adding the lubricant to the alloy raw meal powder, the advantage being in that the flowability can be secured during compression molding in the magnetic field and the orientation can be improved. The orientation of the sintered magnet will become poor and, as a result, the remanent flux density and maximum energy product exhibiting the magnetic properties will be lowered. On the other hand, if the mean grain diameter is larger than 8 μm, the coercive force will be lowered because the crystal is large. In addition, since the surface area of the grain boundary becomes smaller, the ratio of concentration of the residual carbon near the grain boundary becomes large and the coercive force becomes largely lowered. Further, the residual carbon reacts with Dy and/or Tb, and the diffusion of Dy into the grain boundary phase is impeded and the time of diffusion becomes longer, resulting in poor productivity.

As shown in FIG. 2, a vacuum vapor processing apparatus 1 for executing the above-described processing has a vacuum chamber 12 in which a pressure can be reduced to, and kept at, a predetermined pressure (e.g., $1\times10^{-5}$ Pa) through an evacuating means 11 such as turbo-molecular pump, cryopump, diffusion pump, and the like. There is disposed in the vacuum chamber 12 a box body 2 comprising: a rectangular parallelopiped box part 21 with an upper surface being open; and a lid part 22 which is detachably mounted on the open upper surface of the box part 21.

A downwardly bent flange 22*a* is formed along the entire circumference of the lid part 22. When the lid part 22 is mounted in position on the upper surface of the box part 21, the flange 22*a* is fitted into the outer wall of the box part 21 (in this case, no vacuum seal such as a metal seal is provided), so as to define a processing chamber 20 which is isolated from the vacuum chamber 11. It is so configured that, when the vacuum chamber 12 is reduced in pressure through the evacuating means 11 to a predetermined pressure (e.g., $1\times10^{-5}$ Pa), the processing chamber 20 is reduced in pressure to a pressure (e.g., $5\times10^{-4}$ Pa) that is higher substantially by half a digit than that in the vacuum chamber 12.

The volume of the processing chamber 20 is set, taking into consideration the average free path of the evaporating material v such that the evaporating material v (molecules) in the vapor atmosphere can be supplied to the sintered magnet S directly or from a plurality of directions by repeating collisions. The surfaces of the box part 21 and the lid part 22 are set to have thicknesses not to be thermally deformed when heated by a heating means to be described hereinafter, and are made of a material that does not react with the evaporating material v.

In other words, when the evaporating material v is, e.g., dysprosium fluoride, in case $Al_2O_3$ which is often used in an ordinary vacuum apparatus is used, there is a possibility that Dy or Nd in the vapor atmosphere reacts with $Al_2O_3$ and form products of reaction on the surface thereof, resulting in penetration of the Al atoms into the vapor atmosphere of Dy and/or Tb. Accordingly, the box body 2 is made, e.g., of Mo, W, V, Ta or alloys of them (including rare earth elements added Mo alloy, Ti added Mo alloy, and the like), CaO, $Y_2O_3$ or oxides of rare earth elements, or constituted by forming an inner lining on the surface of another insulating material. A bearing grid 21*a* of, e.g., a plurality of Mo wires (e.g., 0.1~10 mm (dia.)) is arranged in lattice at a predetermined height from the bottom surface in the processing chamber 20. On this bearing grid 21*a* a plurality of sintered magnets S can be placed side by side. On the other hand, the evaporating material v is appropriately placed on a bottom surface, side surfaces or a top surface of the processing chamber 20.

As the evaporating material v there are used fluorides, containing Dy and/or Tb which largely improves the grain magnetic anisotropy of principal phase, such as dysprosium fluoride and terbium fluoride. Dysprosium fluoride and terbium fluoride are produced by the known method. As the producing method, there are used: a dry method in which oxides of Dy and/or Tb are reacted with anhydrous hydrogen fluoride current at a high temperature (e.g., 750° C.); a method in which oxides of Dy and/or Tb are mixed and react them together at a relatively low temperature (e.g., 300° C.); or a wet method in which hydrofluoric acid is added to an aqueous solution of Dy and/or Tb compound in chlorides and the like to react them, thereby obtaining a precipitate, then cleaning the obtained precipitate, filtering, and further drying and roasting it. According to the arrangement, the evaporating material v can be made of the intermediate products (dysprosium fluoride or terbium fluoride) to be obtained in the process of manufacturing Dy metal or Tb metal from ores. Since their price is low, as compared with the case in which evaporating material v is made of Dy metal or Tb metal, the manufacturing cost of the permanent magnet can be kept low.

If dysprosium fluoride and terbium fluoride are used in executing the vacuum vapor processing, the melting point of the Nd-rich phase (phase containing Dy and/or Tb in the range of 5~80%) lowers due to pluralistic eutectic effect. As a result, the diffusion velocity of the metallic atoms of Dy and/or Tb becomes still greater. In other words, at the time of diffusion into the grain boundary phase, a complicate eutectic such as Nd—F—O—Dy(Tb) and the like is made. In this case, the eutectic point of the Nd-rich phase lying near the grain boundary is lower in the case of polytopic system as compared with the eutectic point of binary system of Dy(Tb)—Fe. Therefore, the velocity of diffusion of the metal atoms of Dy and/or Tb, among the evaporating material v, into the grain boundary phase becomes larger, with the result that the diffusion time is shortened and high workability is attained.

In this case, as the evaporating material v, there may be used an alloy or a fluoride thereof which contains at least one of Nd and Pr (in this case, there may be used didymium which is an alloy of Nd and Pr) in addition to the dysprosium fluoride or terbium fluoride. In this case, the evaporating material v is formulated at a predetermined mixing ratio and by using, e.g., an electric arc furnace an alloy in bulk form is obtained and is placed in a predetermined position in the processing chamber 20. It may also be so arranged that dysprosium fluoride or terbium fluoride in bulk form or in granular form, Nd or Pr or an alloy thereof, and a fluoride containing at least one of Nd and Pr may be separately disposed in the processing chamber 20 at a predetermined weight ratio.

By executing the vacuum vapor processing according to the above, in addition to the fact that, Dy and/or Tb is replaced by Nd of grain particles to thereby improve the crystalline magnetic anisotropy, the strains and defects in the grain boundary are repaired, whereby a still higher coercive force can be possessed. In addition, unlike Dy and/or Tb, since Nd and the like takes the spin orientation in which magnetization takes place in the same orientation as Fe, the remanent flux density and maximum energy product become high. As a result, as compared with the conventional one, there can be obtained a permanent magnet that has still higher magnetic properties. Further, since the eutectic point of Nd-rich phase is lowered due to polytopic eutectic effect, the diffusion velocity of Dy and/or Tb can be made still higher.

The evaporating material v may comprise at least one material of the group consisting of Al, Ag, B, Ba, Be, C, Ca, Ce, Co, Cr, Cs, Cu, Dy, Er, Eu, Fe, Ga, Gd, Ge, Hf, Ho, In, K, La, Li, Lu, Mg, Mn, Mo, Na, Nb, Nd, Ni, P, Pd, Pr, Ru, S, Sb, Si, Sm, Sn, Sr, Ta, Tb, Ti, Tm, V, W, Y, Yb, Zn, and Zr (hereinafter referred to as "elements A"), in place of Nd or Pr or an alloy thereof, or a fluoride containing at least one of Nd and Pr. According to this arrangement, at the time of diffusion into the grain boundary phase, the elements of Al, Cu or Ga get penetrated into the Nd-rich phase to thereby form a complicated eutectic such as Dy(Tb)—Nd(Pr)—Fe—Al(Cu, Ga) and the like. In this case, the eutectic point of the Nd-rich phase lying near the grain boundary is lower in polytopic system as compared with the eutectic point of the binary system of Dy—Fe(Tb—Fe). Therefore, the diffusion velocity of the metal atoms of Dy and/or Tb becomes still faster.

The vacuum chamber 12 is provided with a heating means 3. The heating means 3 is made of a material that does not react with the evaporating material v, in the same manner as is the box body 2, and is arranged so as to enclose the circumference of the box body 2. The heating means 3 comprises: a thermal insulating material of Mo make which is provided with a reflecting surface on the inner surface thereof; and an electric heater which is disposed on the inside of the thermal insulating material and which has a filament of Mo make. By heating the box body 2 by the heating means 3 at a reduced pressure, the processing chamber 20 is indirectly heated through the box body 2, whereby the inside of the processing chamber 20 can be heated substantially uniformly.

A description will now be made of the manufacturing of a permanent magnet M using the above-described vacuum vapor processing apparatus 1. First of all, sintered magnets S made in accordance with the above-described method are placed on the bearing grid 21*a* of the box part 21, and dysprosium fluoride as the evaporating material v is placed on the bottom surface of the box part 21 (according to this, the sintered magnets S and the evaporating material v are disposed at a distance from each other in the processing chamber 20). After having mounted in position the lid part 22 on the open upper surface of the box part 21, the box body 2 is placed in a predetermined position enclosed by the heating means 3 in the vacuum chamber 12 (see FIG. 2). Then through the evacuating means 11 the vacuum chamber 12 is evacuated until it reaches a predetermined pressure (e.g., $1\times10^{-4}$ Pa) (the processing chamber 20 is evacuated to a pressure substantially half-digit higher than the above) and the processing chamber 20 is heated by actuating the heating means 3 when the vacuum chamber 12 has reached the predetermined pressure.

When the temperature in the processing chamber 20 has reached the predetermined temperature under reduced pressure, Dy placed on the bottom surface of the processing chamber 20 is heated to substantially the same temperature as the processing chamber 20, and starts evaporation, and accordingly a vapor atmosphere is formed inside the processing chamber 20. Since the sintered magnets S and Dy are disposed at a distance from each other, when Dy starts evaporation, melted Dy will not be directly adhered to the sintered magnet S whose surface Nd-rich phase is melted. Then Dy atoms in the Dy vapor atmosphere is supplied from a plurality of directions either directly or by repeating collisions, and are supplied to the sintered magnet S that has been heated to substantially the same temperature as Dy. The adhered Dy will be diffused into the grain boundary phase, whereby the permanent magnet M can be obtained.

As shown in FIG. 3, when the evaporating material v in the vapor atmosphere is supplied to the surface of the sintered magnet S so as to form a layer (thin film) L1 made of the evaporating material v, the surface of the permanent magnet M will be remarkably deteriorated (surface roughness becomes worsened) as a result of recrystallization of the evaporating material v that has been adhered to, and deposited on, the surface of the sintered magnet S. In addition, the evaporating material v adhered to, and deposited on, the surface of the sintered magnet S that has been heated to substantially the same temperature during processing gets melted and Dy will be excessively diffused into the grains in a region R1 near the surface of the sintered magnet S. As a result, the magnetic properties cannot be effectively improved or recovered.

That is, once a thin film made of the evaporating material v is formed on the surface of the sintered magnet S, the average composition on the surface of the sintered magnet S adjoining the thin film becomes Dy-rich composition. Once the composition becomes Dy-rich composition, the liquid phase temperature lowers and the surface of the sintered magnet S gets melted (i.e., the principal phase is melted and the amount of liquid phase increases). As a result, the region near the surface of the sintered magnet S is melted and collapsed and thus the asperities increase. In addition, Dy excessively penetrates into the grains together with a large amount of liquid phase and thus the maximum energy product and the remanent flux density exhibiting the magnetic properties are further lowered.

According to this embodiment, dysprosium fluoride in bulk form (substantially spherical shape) having a small surface area per unit volume (specific surface area) was disposed on the bottom surface of the processing chamber 20 in a ratio of 1~10% by weight of the sintered magnet so as to reduce the amount of evaporation at a constant temperature. In addition, when the evaporating material v is dysprosium fluoride, the temperature in the processing chamber 20 was set to a range of 800° C.~1050° C., preferably 900° C.~1000° C., by controlling the heating means 3.

If the temperature in the processing chamber 20 (accordingly the heating temperature of the sintered magnet S) is below 800° C., the velocity of diffusion of Dy atoms of the evaporating material v adhered to the surface of the sintered magnet S into the grain boundary phase is retarded. It is thus impossible to make the Dy atoms to be diffused and homogeneously penetrated into the grain boundary phase of the sintered magnet before the thin film is formed on the surface of sintered magnet S. On the other hand, at the temperature above 1050° C., the vapor pressure increases and thus the dysprosium fluoride molecules in the vapor atmosphere are excessively supplied to the surface of the sintered magnet S. In addition, there is a possibility that Dy would be diffused into the grains. Should Dy be diffused into the grains, the magnetization intensity in the grains is greatly reduced and, therefore, the maximum energy product and the remanent flux density are further reduced.

In order to diffuse Dy into the grain boundary phase before the thin film made up of evaporating material v is formed on the surface of the sintered magnet S, the ratio of a total surface area of the sintered magnet S disposed on the bearing grid 21*a* in the processing chamber 20 to a total surface area of the evaporating material v in bulk form disposed on the bottom surface of the processing chamber 20 is set to fall in a range of $1\times10^{-4}$~$2\times10^{3}$. In a ratio other than the range of $1\times10^{-4}$~$2\times10^{3}$, there are cases where a thin film is formed on the surface of the sintered magnet S and thus a permanent magnet having high magnetic properties cannot be obtained. In this case, the above-described ratio shall preferably fall within a range of $1\times10^{-3}$ to $1\times10^{3}$, and the above-described ratio of $1\times10^{-2}$ to $1\times10^{2}$ is more preferable.

According to the above configuration, by lowering the vapor pressure and also by reducing the amount of evaporation of the evaporating material v, the amount of supply of the evaporating material v to the sintered magnet S is restrained. In addition, by heating the sintered magnet S at a predetermined temperature range while arranging the average grain diameter of the sintered magnet S within a predetermined range, and also by employing dysprosium fluoride as the evaporating material v, the diffusion velocity becomes higher. As a result of the above-described combined effects, the Dy atoms can be efficiently diffused and homogeneously penetrated into the grain boundary phase of the sintered magnet S before the evaporating material v gets deposited on the surface of the sintered magnet S and forms a thin film (see FIG. 1). As a result, the permanent magnet M can be prevented from deteriorating on the surface thereof, and Dy can be restrained from being excessively diffused into the grain boundary near the surface of the sintered magnet. In this manner, by having a Dy-rich phase (a phase containing Dy in the range of 5~80%) in the grain boundary phase and by diffusing Dy only in the neighborhood of the surface of the grains, the magnetization intensity and coercive force are effectively improved. In addition, there can be obtained a permanent magnet M that requires no finishing work and that is superior in productivity.

As shown in FIG. 4, when the sintered magnet S is worked into a desired configuration by a wire cutter, and the like, after having manufactured the above-described sintered magnet S, there are cases where cracks occur in the grains which are the principal phase on the surface of the sintered magnet, resulting in a remarkable deterioration in the magnetic properties (see FIG. 4(*a*)). However, by executing the above-described vacuum vapor processing, there will be formed a Dy-rich phase on the inside of the cracks of the grains near the surface (see FIG. 4(*b*)), whereby the magnetization intensity and coercive force are recovered. On the other hand, by executing the above-described vacuum vapor processing, the grain boundary phase has the Dy-rich phase and further Dy gets diffused only near the surface of the grains. Therefore, even if a permanent magnet is obtained by cutting a sintered magnet in block shape, after having executed the above-described vacuum vapor processing, into a plurality of sliced thin pieces by means of a wire cutter and the like as a post step, the magnetic properties of the permanent magnet get hardly deteriorated. As compared with a case in which: a sintered magnet of block shape having predetermined dimensions is cut into a plurality of thin pieces; the thin pieces are then contained as they are by disposing in position inside the processing chamber; and they are then subjected to the above-described vacuum vapor processing, it is possible, for example, to perform at a shorter time the putting and taking the sintered magnet into, and out of, the processing chamber. Also, the preparatory work for executing the above-described vacuum vapor processing becomes easier, and the finishing work is not required. Consequently, a high productivity can be attained.

Cobalt (Co) has been added to the neodymium magnet of the prior art because a measure to prevent corrosion of the magnet is required. However, according to the present invention, since Dy-rich phase having extremely higher corrosion resistance and atmospheric corrosion resistance as compared with Nd exists on the inside of cracks of grains near the surface of the sintered magnet and in the grain boundary phase, it is possible to obtain a permanent magnet having extremely high corrosion resistance and atmospheric corrosion resistance without using Co. Furthermore, at the time of diffusing Dy(Tb), since there is no intermetallic compound containing Co in the grain boundary phase of the sintered magnet S, the metal atoms of Dy(Tb) are further efficiently diffused.

Finally, after having executed the above-described processing for a predetermined period of time (e.g., 1~72 hours), the operation of the heating means 3 is stopped, Ar gas of 10 KPa is introduced into the processing chamber 20 through a gas introducing means (not illustrated), evaporation of the evaporating material v is stopped, and the temperature in the processing chamber 20 is once lowered to, e.g., 500° C. Continuously the heating means 3 is actuated once again and the temperature in the processing chamber 20 is set to a range of 450° C.~650° C., and heat treatment for removing the strains in the permanent magnets is executed to further improve or recover the coercive force. Finally, the processing chamber 20 is rapidly cooled substantially to room temperature and the box body 2 is taken out of the vacuum chamber 12.

In the embodiment of the present invention, a description has been made of an example in which dysprosium fluoride is used as the evaporating material v. However, within a heating temperature range (a range of 900° C.~1000° C.) of the sintered magnet S that can accelerate the diffusion velocity, terbium fluoride that is low in vapor pressure can be used. Or else, its alloy may be used. It was so arranged that an evaporating material v in bulk form and having a small specific surface area was used in order to reduce the amount of evaporation at a certain temperature. However, without being limited thereto, it may be so arranged that a pan having a recessed shape in cross section is disposed inside the box part 21 to contain in the pan the evaporating material v in granular form or bulk form, thereby reducing the specific surface area. In addition, after having placed the evaporating material v in the pan, a lid (not illustrated) having a plurality of openings may be mounted.

In the embodiment of the present invention, a description has been made of an example in which the sintered magnet S and the evaporating material v were disposed in the processing chamber 20. However, in order to enable to heat the sintered magnet S and the evaporating material v at different temperatures, an evaporating chamber (another processing chamber, not illustrated) may be provided inside the vacuum chamber 12, aside from the processing chamber 20, and another heating means may be provided for heating the evaporating chamber. After having evaporated the evaporating material v inside the evaporating chamber, the evaporating material v in the vapor atmosphere may be arranged to be supplied to the sintered magnet inside the processing chamber 20 through a communicating passage which communicates the processing chamber 20 and the evaporating chamber together.

In this case, in case the evaporating material v is dysprosium fluoride, the evaporating chamber may be heated at a range of 700° C.~1050° C. At a temperature below 700° C., there cannot reach a vapor pressure at which the evaporating material v can be supplied to the surface of the sintered magnet S so that Dy can be diffused and homogeneously penetrated into the grain boundary phase. On the other hand, in case the evaporating material v is terbium fluoride, the evaporating chamber may be heated to a range of 900° C.~1150° C. At a temperature below 900° C., there cannot reach a vapor pressure at which the evaporating material v can be supplied to the surface of the sintered magnet S. On the other hand, at a temperature above 1150° C., Tb gets diffused into the grains and thus the maximum energy product and the remanent flux density will be lowered.

In order to remove soil, gas or moisture adsorbed on the surface of sintered magnet S before Dy and/or Tb is diffused into the grain boundary phase, it may be so arranged that the vacuum chamber 12 is reduced to a predetermined pressure (e.g., $1\times10^{-5}$ Pa) through the evacuating means 11 and that the processing chamber 20 is reduced to a pressure (e.g., $5\times10^{-4}$ Pa) higher substantially by half-digit than the pressure in the processing chamber 20, thereafter maintaining the pressures for a predetermined period of time. At that time, by actuating the heating means 3, the inside of the processing chamber 20 may be heated to, e.g., 100° C., thereafter maintaining it for a predetermined period of time.

On the other hand, the following arrangement may be made, i.e., a plasma generating apparatus (not illustrated) of a known construction for generating Ar or He plasma inside the vacuum chamber 12 is provided and, prior to the processing inside the vacuum chamber 12, there may be executed a preliminary processing of cleaning the surface of the sintered magnet S by plasma. In case the sintered magnet S and the evaporating material v are disposed in the same processing chamber 20, a known conveyor robot may be disposed in the vacuum chamber 12, and the lid part 22 may be mounted inside the vacuum chamber 12 after the cleaning has been completed.

Further in the embodiment of the present invention, a description has been made of an example in which the box body 2 was constituted by mounting the lid part 22 on an upper surface of the box part 21. However, if the processing chamber 20 is isolated from the vacuum chamber 12 and can be reduced in pressure accompanied by the pressure reduction in the vacuum chamber 12, it is not necessary to limit to the above example. For example, after having housed the sintered magnet S into the box part 21, the upper opening thereof may be covered by a foil of Mo make. On the other hand, it may be so constructed that the processing chamber 20 can be hermetically closed in the vacuum chamber 12 so as to be maintained at a predetermined pressure independent of the vacuum chamber 12.

As the sintered magnet S, the smaller is the amount of oxygen content, the larger becomes the velocity of diffusion of Dy and/or Tb into the grain particle phase. Therefore, the oxygen content of the sintered magnet S itself may be below 3000 ppm, preferably below 2000 ppm, and most preferably below 1000 ppm.

EXAMPLE 1

In Example 1, as the Nd—Fe—B based sintered magnet, there was used one in which the composition was 27Nd-3Dy- 1B-0.1Cu-ba1.Fe, the oxygen content of the sintered magnet S itself was 1500 ppm, the average grain size was 5 μm, and which was fabricated into a shape of 20×10×5 (thickness) mm. In this case, the surface of the sintered magnet S was finished so as to have a surface roughness of below 10 μm, and was thereafter washed with acetone.

By using the above-described vacuum vapor processing apparatus 1, a permanent magnet M was obtained by the above-described vacuum vapor processing. In this case, a box body 2 of Mo make having the dimensions of 50×150×60 mm was used, and 60 sintered magnets S were disposed on the bearing grid 21*a* at an equal distance from one another. As the evaporating material v, 100 grams in total amount of dysprosium fluoride (99.5%, manufactured by Wako Junyaku K.K.) or terbium fluoride (99.5%, manufactured by Wako Junyaku K.K.) were respectively disposed on the bottom surface of the processing chamber 20.

Then, by actuating the evacuating means, the vacuum chamber was once reduced in pressure to $1\times10^{-4}$ Pa (the pressure inside the processing chamber was about $5\times10^{-3}$ Pa). The heating temperature of the processing chamber 20 by the heating means 3 was set to 850° C. in case the evaporating material v was dysprosium fluoride (Example 1b), and to 1000° C. in case the evaporating material v was terbium fluoride (Example 1a). Once the processing chamber 20 reached the above-described temperature, the above-described vacuum vapor processing was executed for 1 hour, 10 hours, or 18 hours, respectively. Thereafter, heat treatment for removing the strains in the permanent magnets was executed. In this case, the processing temperature was set to 550° C. and the processing time was set to 60 minutes. Then, the product thus obtained was machined by using a wire cutter to dimensions of 10 mm (dia.)×5 mm.

FIGS. 5 and 6 are tables showing average values of magnetic properties when permanent magnets were obtained according to the above by using Dy of 99.9% purity in bulk form as the evaporating material (Comparative Example 1a) and by using Tb of 99.9% purity in bulk form as the evaporating material (Comparative Example 1b), in comparison with average values of magnetic properties when permanent magnets were obtained by the vacuum vapor processing under the same conditions as in the above Example 1a and Example 1b. According to these tables, in the case of the evaporating material containing therein Dy in the Comparative Example 1a, as the time of vacuum vapor processing becomes longer, the coercive force becomes higher. When the time of processing was set to 18 hours, the coercive force was about 24 kOe. In the Example 1a, on the other hand, it can be seen that the coercive force above 24 kOe was obtained only by executing about 10 hours of vacuum evaporating processing (see FIG. 5).

On the other hand, in the case of the evaporating material containing Tb, it can be seen in the Comparative Example 1b that the longer becomes the time for vacuum vapor processing, the higher becomes the coercive force. When the time for processing was set to 18 hours, the coercive force was about 28 kOe. On the other hand, it can be seen that, in the Example 1b, only by executing the vacuum vapor processing for only about 10 hours, the coercive force of above 28 kOe was obtained (see FIG. 6). Judging from the above, it can be seen that the time for processing, i.e., the diffusion time of Dy or Tb can be shortened.

EXAMPLE 2

In Example 2 there were used Nd—Fe—B sintered magnets that are the same as in Example 1. In this case, after having finished the surfaces of the sintered magnets so as to have surface roughness of below 100 μm, cleaning was made using isopropylalcohol.

Then, by using the above-described vacuum vapor processing apparatus 1, permanent magnets M were obtained by the above-described vacuum vapor processing. In this case, as a box body 2 there was used one made of Mo having dimensions of 200×170×60 mm, 120 sintered magnets S were disposed on the bearing grid 21*a* at an equal distance between one another. Further, as the evaporating material v, $DyF_3$ (99.5%, manufactured by Wako Junyaku K.K.) or $TbF_3$ (99.5%, manufactured by Wako Junyaku K.K.) and $NdF_3$ was formulated in a predetermined mixing ratio. Alloys of bulk form of about 1 mm (dia.) were obtained in an arc melting furnace and 200 g in total amount were disposed on the bottom surface of the processing chamber 20. Also, as the evaporating material v, $50DyF_3$ or $50TbF_3$, and $50PrF_3$ were formulated in the described mixing ratio. Alloys of bulk form of about 1 mm (dia.) were obtained and 200 g in total amount were disposed on the bottom surface of the processing chamber 20.

Then, by actuating the evacuating means, the vacuum chamber was once reduced in pressure to $1\times10^{-4}$ Pa (the pressure inside the processing chamber was about $5\times10^{-3}$ Pa). The heating temperature of the processing chamber 20 by the heating means 3 was set to 850° C. in case the evaporating material contained $DyF_3$ (Example 2a), and to 1000° C. in case the evaporating material contained $DyF_3$ (Example 2b). Once the processing chamber 20 reached the above-described temperature, the above-described vacuum vapor processing was executed for 10 hours. Thereafter, heat treatment for removing the strains in the permanent magnets was executed. In this case, the processing temperature was set to 550° C. and the processing time was set to 60 minutes. Then, the product thus obtained was machined by using a wire cutter to dimensions of 10 mm (dia.)×5 mm.

FIGS. 7 and 8 are tables showing average values of magnetic properties when permanent magnets were obtained according to the above by using Dy metal or Tb metal as the evaporating material v and, when the above-described temperature has been reached, the above-described vacuum vapor processing was executed in this state for 5 hours (Comparative Example 2a, Comparative Example 2c), or for 10 hours (Comparative Example 2b, Comparative Example 2d), thereby obtaining permanent magnets. According to these tables, in the case of the evaporating material v containing therein Dy (Comparative Example 2a, Comparative Example 2b), the longer becomes the time of vacuum vapor processing, the higher becomes the coercive force, which was found to be 24 kOe. On the other hand, in Example 2a, in case the evaporating material v was an alloy of $DyF_3$ and $NdF_3$, even if the alloy was formulated by mixing Nd in a ratio of 99% by weight, the coercive force became above 26 kOe, which is higher than the coercive force of the Comparative Examples 2a, 2b, thereby obtaining permanent magnets of high magnetic properties. In addition, in case the evaporating material was an alloy of $DyF_3$ and $PrF_3$, it can be seen that a high coercive force of 27.5 kOe was obtained (see FIG. 7).

On the other hand, also in the case of the evaporating material containing Tb (Comparative Example 2c, Comparative Example 2d), the longer became the time of vacuum vapor processing, the higher became the coercive force, which was found to be about 28 kOe. To the contrary, in Example 2b, in case the evaporating material v was an alloy of $TbF_3$ and $NdF_3$, even if Nd was formulated in a mixing ratio of 10~99% by weight, the coercive force became above 32 kOe, resulting in higher coercive forces than those in Comparative Examples 2a, 2b, whereby it can be seen that permanent magnets having higher magnetic properties were obtained (see FIG. 8).

EXAMPLE 3

In Example 3, as the Nd—Fe—B based sintered magnet, there was used one in which the composition was 27Nd-3Dy-1B-0.1Cu-ba1.Fe, the oxygen content of the sintered magnet S itself was 1500 ppm, the average grain size was 5 μm, and which was fabricated into a shape of 40×10×4 (thick) mm. In this case, the surface of the sintered magnet S was roughly finished so as to have a surface roughness of below 50 μm, and was thereafter subjected to chemical etching with nitric acid.

Then, by using the above-described vacuum vapor processing apparatus 1, permanent magnets M were obtained by the above-described vacuum vapor processing. In this case, as the box body 2, there was used one of Mo—Y make having the dimensions of 200×170×60 mm, and 60 sintered magnets S were disposed on the bearing grid 21*a* at an equal distance from one another. As the evaporating material v, dysprosium fluoride (99.5%, manufactured by Wako Junyaku K.K.) or terbium fluoride (99.5%, manufactured by Wako Junyaku K.K.) and elements A alloy were weighed to make an alloy of $90DyF_3$ or $90TbF_3$, and 10A alloy. An alloy (about 1 mm) of bulk form was thus obtained in an electric arc furnace and was disposed on the bottom surface of the processing chamber 20 in 300 grams of total amount.

Then, by actuating the evacuating means, the vacuum chamber was once reduced in pressure to $1\times10^{-4}$ Pa (the pressure inside the processing chamber was about $5\times10^{-3}$ Pa). The heating temperature of the processing chamber 20 by the heating means 3 was set to 850° C. in case the evaporating material v contained dysprosium fluoride (Example 3a), and to 1000° C. in case the evaporating material v contained terbium fluoride (Example 3b). Once the processing chamber 20 reached the above-described temperature, the above-described vacuum vapor processing was executed for 10 hours in this state. Thereafter, heat treatment for removing the strains in the permanent magnets was executed. In this case, the processing temperature was set to 550° C. and the processing time was set to 60 minutes. Then, the product thus obtained was machined by using a wire cutter to dimensions of 10 mm (dia.)×5 mm.

FIGS. 9 and 10 are tables showing average values of magnetic properties of permanent magnets that were obtained in the above-described Example 3, together with the average values (Comparative Examples 3a, 3b) of the magnetic properties of the permanent magnets obtained, in a similar manner as in Example 3, without formulating the elements A. According to these tables, the following can be seen, i.e., that while the coercive force was about 24 kOe in Comparative Example 3a, there was obtained coercive forces above 26.4 kOe and, depending on the conditions, even above 28 kOe by combining the elements A to the dysprosium fluoride as the evaporating material v. The coercive force can thus be seen to have further improved (see FIG. 9).

On the other hand, while the coercive force was about 28 kOe in Comparative Example 3b, it was possible to obtain a coercive force of above 29.4 kOe, and even a coercive force of 30, depending on conditions, by adding elements A to terbium fluoride as the evaporating material v in Example 3b, whereby the coercive force was further improved.

EXAMPLE 4

In Example 4, there was used the same Nd—Fe—B based sintered magnet as in Example 1. In Example 4, however, there was used one in which the oxygen content of the sintered magnet S itself was 1500 ppm, the average grain size was 5 μm, and which was fabricated into block shape of 10×10×10 (thick) mm. Then, by using the above-described vacuum vapor processing apparatus 1, and as the evaporating material v there was used $DyF_3$ (99.5%, manufactured by Wako Junyaku Kabushiki Kaisha) that was manufactured in the same manner as in Example 1, and vacuum vapor processing was executed under the same conditions as in Example 1. In this case, the processing time after the heating temperature in the processing chamber 20 reached 900° C. was made to be 12 hours. Further, as the box body 2, there was used one of Mo make having dimensions of 200×170×60 mm and 30 sintered magnets S were disposed on the bearing grid 21*a* at an equal distance to one another.

Then heat treatment was executed to remove the strains in the permanent magnets. In this case, the processing temperature was set to 550° C. and the processing time was set to 60 minutes. Thereafter, by using a wire cutter, the products thus obtained were cut into the thickness of 1 mm in a direction perpendicular to the magnetic alignment direction, thereby manufacturing permanent magnets of 1 mm thick.

FIG. 11 is a table showing average values of magnetic properties of the permanent magnet pieces obtained in the above Example 4 together with the average values of the magnetic properties of the sintered magnets in block form (Comparative Example 4a), the one cut into 1 mm in thickness without subjecting the sintered magnet to the vacuum vapor processing (Comparative Example 4b), and permanent magnet in block form that was subjected to vacuum vapor processing (Comparative Example 4c). According to this table it can be seen that, by executing vacuum vapor processing, the coercive force further improved and, even if they were subsequently cut, the coercive force did not lower, and a coercive force of 18.2 kOe was obtained.

BRIEF DESCRIPTION OF THE DRAWINGS

FIG. 5 is a table showing average values of magnetic properties of the permanent magnet manufactured in accordance with Example 1a;

FIG. 6 is a table showing average values of magnetic properties of the permanent magnet manufactured in accordance with Example 1b;

FIG. 7 is a table showing average values of magnetic properties of the permanent magnet manufactured in accordance with Example 2a;

FIG. 8 is a table showing average values of magnetic properties of the permanent magnet manufactured in accordance with Example 2b;

FIG. 9 is a table showing average values of magnetic properties of the permanent magnet manufactured in accordance with Example 3a;

FIG. 10 is a table showing average values of magnetic properties of the permanent magnet manufactured in accordance with Example 3b; and FIG. 11 is a table showing average values of magnetic properties of the permanent magnet manufactured in accordance with Example 4.

DESCRIPTION OF REFERENCE NUMERALS AND CHARACTERS

Figure 1:
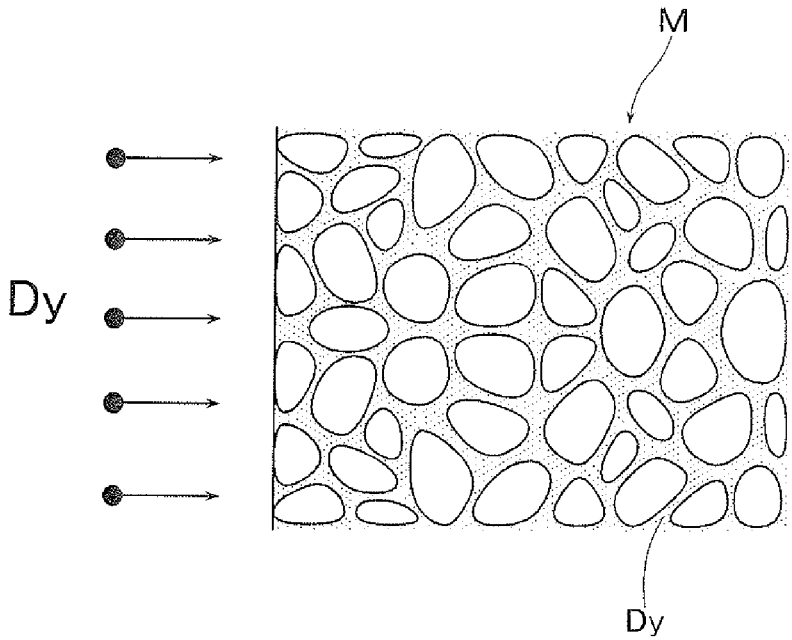
FIG. 1 is a schematic explanatory view of a cross-section of the permanent magnet manufactured in accordance with this invention.
Figure 2:
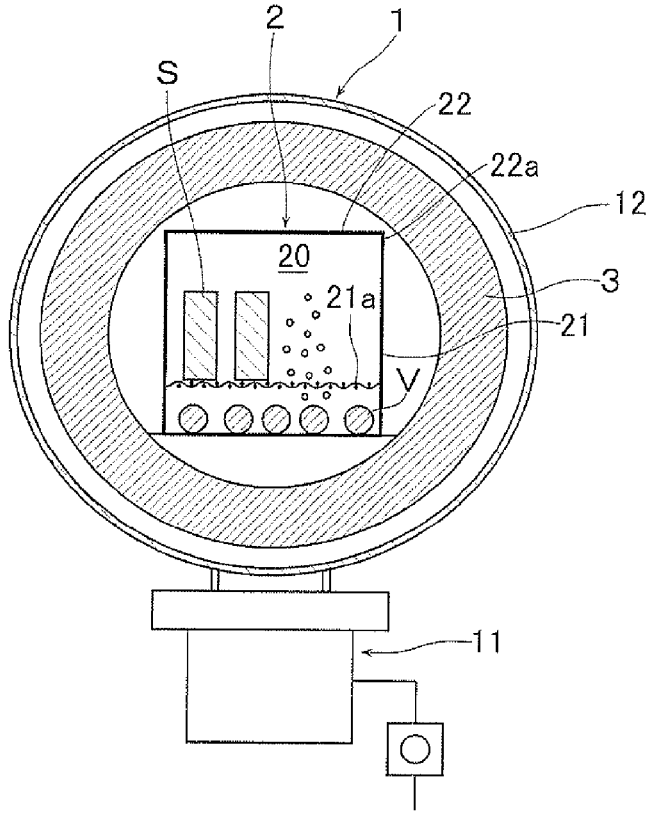
FIG. 2 is a schematic view of the vacuum processing apparatus for executing the processing of this invention.
Figure 3:
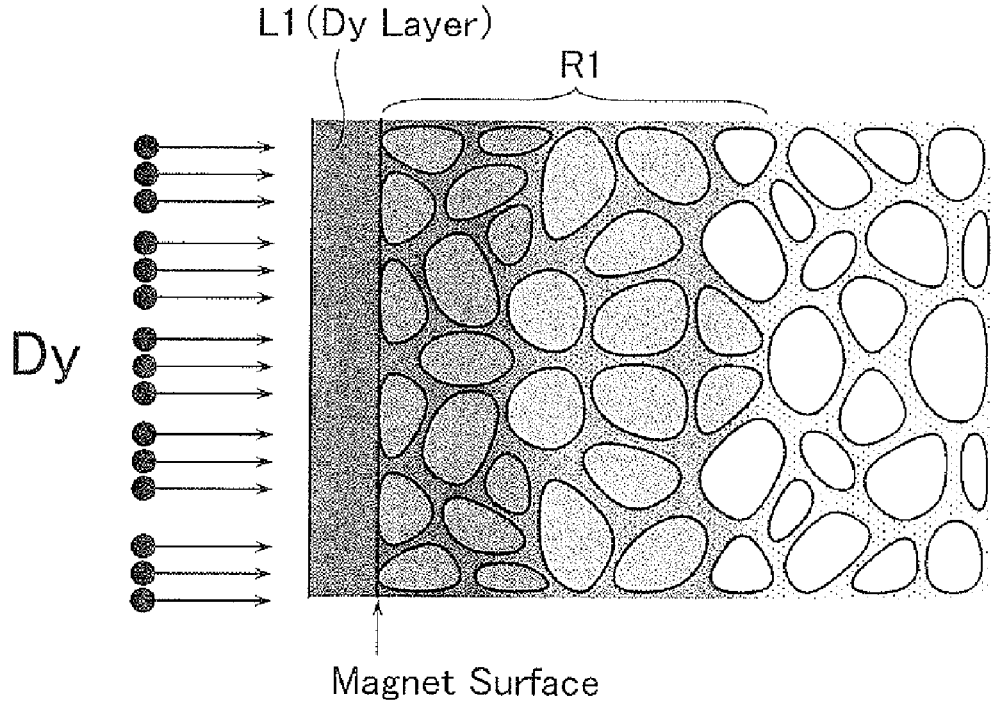
FIG. 3 is a schematic explanatory view of a cross-section of a permanent magnet manufactured in accordance with a prior art.
Figure 4A:
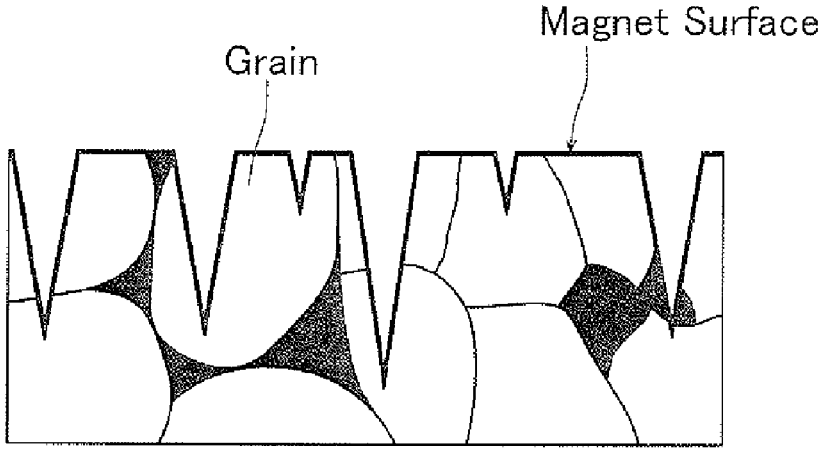
FIG. 4(*a*) is an explanatory view showing deterioration of the surface of the sintered magnet caused by machining, and FIG. 4(*b*) is an explanatory view showing the surface condition of a permanent magnet manufactured in accordance with this invention.
Figure 4B:
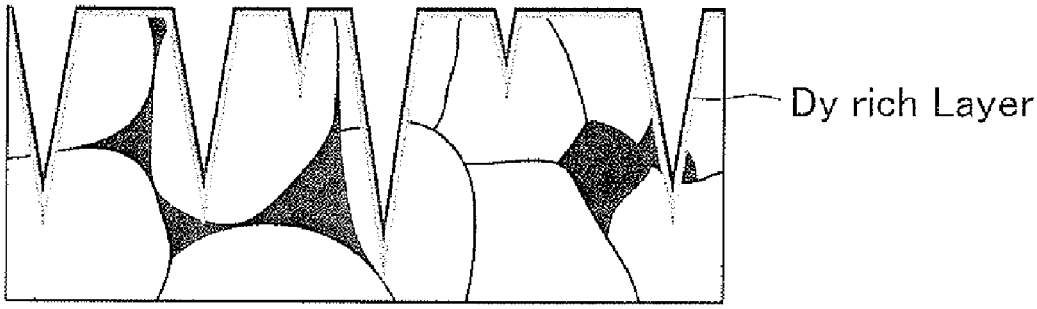

1 vacuum vapor processing apparatus
12 vacuum chamber
2 box body
21 box part
22 lid part
20 processing chamber
3 heating means
S sintered magnet
M permanent magnet
v evaporating material

What is claimed is:

1. A method of manufacturing a permanent magnet, comprising:

heating to a predetermined temperature an iron-boron-rare earth based sintered magnet disposed in a processing chamber;

evaporating an evaporating material comprising a fluoride including at least one of Dy and Tb, disposed in the processing chamber or another processing chamber;

adhering, through a vapor atmosphere, the evaporated evaporating material to a surface of the sintered magnet; and diffusing metal atoms of the at least one of Dy and Tb of the adhered evaporating material into a grain boundary phase of the sintered magnet.

2. The method of manufacturing a permanent magnet according to claim 1, wherein the evaporating material further comprises a fluoride including at least one of Nd and Pr.

3. The method of manufacturing a permanent magnet according to claim 1, wherein the evaporating material further comprises at least one material of the group consisting of Al, Ag, B, Ba, Be, C, Ca, Ce, Co, Cr, Cs, Cu, Dy, Er, Eu, Fe, Ga, Gd, Ge, Hf, Ho, In, K, La, Li, Lu, Mg, Mn, Mo, Na, Nb, Nd, Ni, P, Pd, Pr, Ru, S, Sb, Si, Sm, Sn, Sr, Ta, Tb, Tm, Ti, V, W, Y, Yb, Zn, and Zr.

4. The method of manufacturing a permanent magnet according to claim 1, wherein the sintered magnet and the evaporating material are disposed at a distance from each other.

5. The method of manufacturing a permanent magnet according to claim 1, further comprising executing increasing or decreasing an amount of evaporation at a constant temperature by varying a specific surface area of the evaporating material to be disposed in the processing chamber or the another processing chamber, thereby adjusting an amount of supply of the evaporated evaporating material to the surface of the sintered magnet.

6. The method of manufacturing a permanent magnet according to claim 1, further comprising:

disposing the sintered magnet in the processing chamber; and thereafter reducing a pressure in the processing chamber to a predetermined pressure and keeping the pressure thereat.

7. The method of manufacturing a permanent magnet according to claim 6, further comprising, after having reduced the pressure in the processing chamber to the predetermined pressure, heating the processing chamber to a predetermined temperature and keeping the temperature thereat.

8. The method of manufacturing a permanent magnet according to claim 1, further comprising, cleaning the surface of the sintered magnet by plasma.

9. The method of manufacturing a permanent magnet according to claim 1, further comprising, after having diffused the metal atoms into the grain boundary phase, heat-treating the permanent magnet at a predetermined temperature below the said temperature to remove strains of the permanent magnet.

10. The method of manufacturing a permanent magnet according to claim 1, further comprising, after having diffused at least one of Dy and Tb into the grain boundary phase of the sintered magnet, cutting the sintered magnet into a predetermined thickness in a direction perpendicular to a magnetic alignment direction.

11. The method of manufacturing a permanent magnet according to claim 2, wherein the sintered magnet and the evaporating material are disposed at a distance from each other.

12. The method of manufacturing a permanent magnet according to claim 2, further comprising executing increasing or decreasing an amount of evaporation at a constant temperature by varying a specific surface area of the evaporating material to be disposed in the processing chamber or the another processing chamber, thereby adjusting an amount of supply of the evaporated evaporating material to the surface of the sintered magnet.

13. The method of manufacturing a permanent magnet according to claim 2, further comprising:

disposing the sintered magnet in the processing chamber; and thereafter reducing a pressure in the processing chamber to a predetermined pressure and keeping the pressure thereat.

14. The method of manufacturing a permanent magnet according to claim 2, further comprising, cleaning the surface of the sintered magnet by plasma.

15. The method of manufacturing a permanent magnet according to claim 2, further comprising, after having diffused the metal atoms into the grain boundary phase, heat-treating the permanent magnet at a predetermined temperature below the said temperature to remove strains of the permanent magnet.

16. The method of manufacturing a permanent magnet according to claim 2, further comprising, after having diffused at least one of Dy and Tb into the grain boundary phase of the sintered magnet, cutting the sintered magnet into a predetermined thickness in a direction perpendicular to the magnetic alignment direction.

* * * * *